US008002255B2

(12) United States Patent
Kawaguchi et al.

(10) Patent No.: US 8,002,255 B2
(45) Date of Patent: Aug. 23, 2011

(54) METHOD OF FOLDING IN THE MIDDLE AND SHEET POST-PROCESSING APPARATUS PROVIDED WITH SADDLE UNIT

(75) Inventors: Takahiro Kawaguchi, Mishima (JP); Shinichiro Mano, Hadano (JP); Ken Iguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 345 days.

(21) Appl. No.: 12/111,695

(22) Filed: Apr. 29, 2008

(65) Prior Publication Data

US 2009/0036287 A1 Feb. 5, 2009

Related U.S. Application Data

(60) Provisional application No. 60/952,832, filed on Jul. 30, 2007, provisional application No. 60/968,040, filed on Aug. 24, 2007, provisional application No. 60/968,545, filed on Aug. 28, 2007, provisional application No. 60/969,149, filed on Aug. 30, 2007.

(51) Int. Cl.
*B65H 45/12* (2006.01)

(52) U.S. Cl. ..... 270/45; 270/32; 270/58.07

(58) Field of Classification Search ..... 270/32, 270/37, 58.07; 493/435, 442, 445
See application file for complete search history.

(56) References Cited

U.S. PATENT DOCUMENTS

| | | | | |
|---|---|---|---|---|
| 6,905,118 | B2 | 6/2005 | Yamada et al. | |
| 2007/0060459 | A1 * | 3/2007 | Hayashi | 493/434 |
| 2008/0315488 | A1 * | 12/2008 | Iguchi et al. | 270/37 |

FOREIGN PATENT DOCUMENTS

| | | |
|---|---|---|
| JP | PH10-218483 | 8/1998 |
| JP | P2003-182928 | 7/2003 |
| JP | P2004-91129 | 3/2004 |
| JP | P2004-106991 | 4/2004 |
| JP | P2005-239420 | 9/2005 |
| JP | P2007-91469 | 4/2007 |

* cited by examiner

*Primary Examiner* — Leslie A Nicholson, III
(74) *Attorney, Agent, or Firm* — Patterson & Sheridan, LLP

(57) ABSTRACT

A saddle unit provided with a fold-enhancing unit for performing fold enhancement of sheets of paper folded in the middle. The fold-enhancing unit includes a fold-enhancing roller mechanism which performs the fold-enhancing operation in the direction orthogonal to the sheet carrying direction. The fold-enhancing roller mechanism includes a fold-enhancing roller pair that pinches and presses a bundle of sheets at a nip. The roller guide pair provided in the fold-enhancing roller mechanism guides the sheets of paper to the nip of the fold-enhancing roller pair when enhancing the fold of the sheets of paper. The saddle unit changes one or both of the number of times and the velocity of the reciprocating movement according to one or both of the number of sheets of paper and the quality mode which is entered and set by the user from the operation panel of an image forming apparatus or job-set by the personal computer by a user.

20 Claims, 19 Drawing Sheets

METHOD OF FOLDING IN THE MIDDLE AND SHEET POST-PROCESSING APPARATUS PROVIDED WITH SADDLE UNIT

CROSS-REFERENCE TO RELATED APPLICATIONS

This application is based upon and claims the benefit of priority from the prior U.S. Patent Application No. 60/952,832, filed on 30 Jul. 2007, the prior U.S. Patent Application No. 60/968,545, filed on 28 Aug. 2007, the prior U.S. Patent Application No. 60/968,040, filed on 24 Aug. 2007, and the prior U.S. Patent Application No. 60/969,149, filed on 30 Aug. 2007, the entire contents of which are incorporated herein by reference.

BACKGROUND OF THE INVENTION

1. Field of the Invention

The present invention relates to a sheet post-processing apparatus for stapling sheets of paper after having formed images thereon and then folding the same in the middle to form a booklet and, more specifically, to a sheet post-processing apparatus in which the accuracy of middle folding is improved.

2. Description of the Related Art

Some of image forming apparatuses such as copying machines employ a sheet post-processing apparatus for performing a post-processing such as sorting or stapling sheets of papers formed with images thereon. Among others, a saddle unit which performs a saddle stitch process (staple) and then folding the sheets of paper in the middle to form a booklet is required the accuracy of the middle folding from the necessity of finish in good appearance.

The saddle unit is required specifically to allow easy and complete removal of jammed paper in case of a paper jam and to be able to fold the sheets of paper properly in the middle.

As a mechanism for releasing the paper jam, there is proposed a mechanism in which a stapler portion is configured as a single unit, and the unit is drawably mounted to a main body (for example, JP-A-2004-91129).

However, this technology has a problem that it is difficult to remove the sheet jammed in the unit and, when the sheet is forcedly pulled out, the accuracy in assembly of the unit is impaired.

As a mechanism for folding sheets of paper in the middle in good appearance, there is proposed a mechanism having a second folding roller which moves in the direction orthogonal to the direction of the middle holding, and the folding roller reciprocates the folded portion of the sheets of paper after having folded in the middle several times to ensure the folded state (for example, JP-A-2003-182928).

There is also proposed a technology to change the direction of movement of the second folding roller depending on the sheet size (for example, JP-A-2007-91469).

However, with these technologies, when the size of the sheets of paper is small, and when the bundle of sheets is thick, the force for ensuring the folded state is not transmitted sufficiently to the sheets of paper. Therefore, there arises a problem that the booklet after having folded in the middle is bulged.

BRIEF SUMMARY OF THE INVENTION

It is an object of the present invention to provide a sheet post-processing apparatus having a saddle unit in which the accuracy of middle holding is improved.

In an aspect of the present invention, the sheet post-processing apparatus includes a saddle unit. The saddle unit includes: a folding blade that presses and turns in stacked sheets of paper having images formed thereon; a middle-folding roller pair that folds the sheets of paper turned-in in the middle by the folding blade by pinching and pressing the same at a nip; and a fold-enhancing unit provided downstream of the middle-folding rollers in the sheet carrying direction for enhancing the folded of the sheets of paper folded in the middle. The fold-enhancing unit including: a fold-enhancing roller mechanism. The fold-enhancing roller mechanism including: a fold-enhancing roller pair that pinches and presses the sheets of paper folded in the middle at the nip, and a roller guide pair which is provided at the front and rear in the direction of advancement of the fold-enhancing roller mechanism so as to define an opening at the nip between the upper fold-enhancing roller and the lower fold-enhancing roller rotatably fixed to the fold-enhancing roller mechanism, and is bent downward at free ends so as to cover part of the lower fold-enhancing roller, and the fold-enhancing roller mechanism moves in the direction orthogonal to the sheet carrying direction. Accordingly, there is provided the saddle unit in which the folding accuracy and the folding quality are improved.

DETAILED DESCRIPTION OF THE INVENTION

Figure 1:
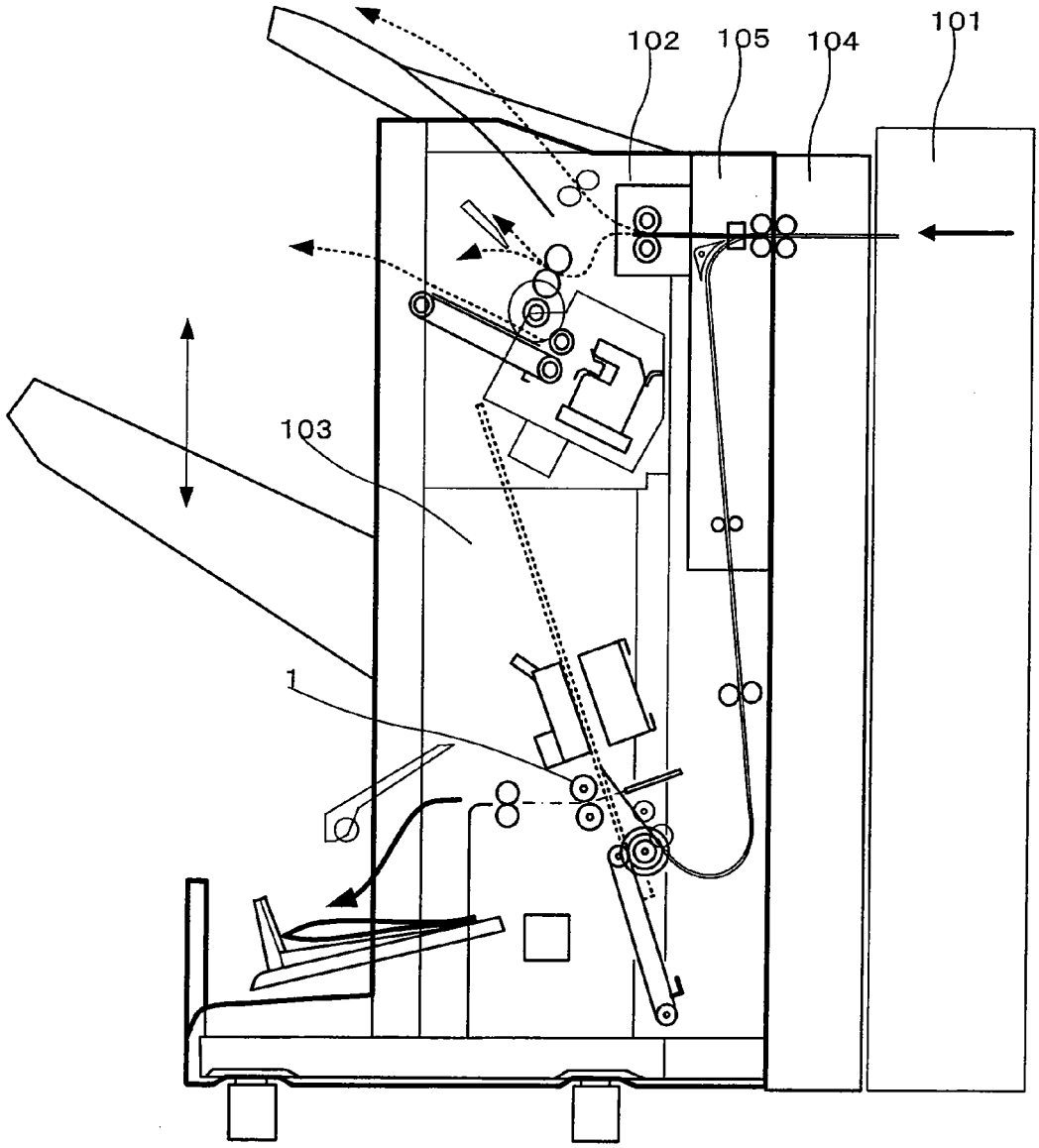
FIG. 1 is a cross-sectional view generally showing a sheet post-processing apparatus according to an embodiment.

Throughout this description, the embodiments and examples shown should be considered as exemplars, rather than limitations on the apparatus and methods of the present invention.

Referring now to the drawings, an embodiment of the sheet post-processing apparatus in which stackability of the sheets of paper having formed with images thereon is improved (hereinafter referred to as "sheet post-processing apparatus") according to the present invention. The same parts are represented by the same reference numerals and overlapped description is omitted throughout the drawings.

(Post-Processing of Sheets of Paper)

FIG. 1 is a cross-sectional view generally showing a sheet post-processing apparatus according to an embodiment. As shown in FIG. 1, the sheet post-processing apparatus includes a punching unit 104 for punching sheets of paper after having formed with images thereon received from an image forming apparatus 101 provided adjacently thereto; a finisher 102 for performing a staple process and a sort process; a saddle unit 103 for saddle stitching (stapling) sheets of paper and folding the same in the middle for forming a booklet; and a coupler 105 for connecting the punching unit 104 for punching the sheets of paper, the finisher 102 and the saddle unit 103.

Some of the above-described components may be omitted from the sheet post-processing apparatus or other components may be added to the sheet post-processing apparatus.

When forming the booklet, the sheets of paper after having formed with images thereon pass through the punching unit 104. Then, the coupler 105 branches the sheets of paper and carries the same to the saddle unit 103. The saddle unit 103 receives the sheets of paper, stacks a predetermined number of sheets of paper, vertically aligns the sheets of paper, and applies the staple process to fold the same in the middle. The middle folding of the sheets of paper is done by a middle-folding roller pair 1.

(General Description of Saddle Unit)

Figure 2:
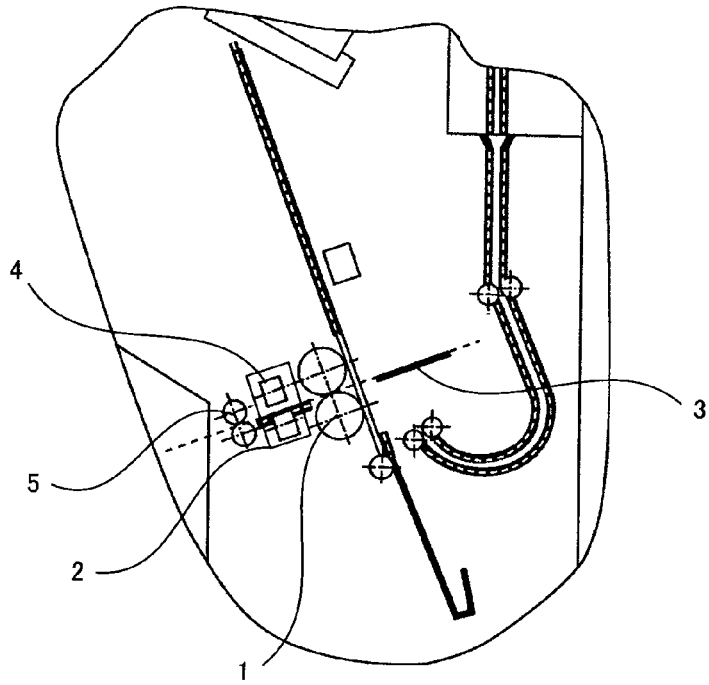
FIG. 2 is a schematic diagram showing a portion near middle-folding rollers 1 of a saddle unit 103.

FIG. 2 is a schematic diagram showing a portion near the middle-folding rollers 1 of the saddle unit 103. As shown in FIG. 2, the saddle unit 103 includes a middle-folding blade 3 that presses and turns-in the sheets of paper, the middle-folding roller pair 1, a fold-enhancing unit 2 provided on the downstream of the middle-folding rollers 1 in the sheet carrying direction, and a discharge roller 5 for discharging the sheet of paper folded in the middle.

The middle-folding blade 3 pushes the vertically aligned sheets of paper into a nip of the middle-folding roller pair 1. The middle-folding rollers 1 rotate and press the sheets of paper pushed by the middle-folding blade 3 to fold the same in the middle.

The fold-enhancing unit 2 pressurizes and enhances the folded portion of the sheets of paper folded in the middle by a fold-enhancing roller pair 4 while rotating and moving thereon. After having enhanced the fold, the discharge roller 5 discharges a bundle of sheets of paper formed into a booklet.

(Fold-Enhancing Unit)

Figure 3:
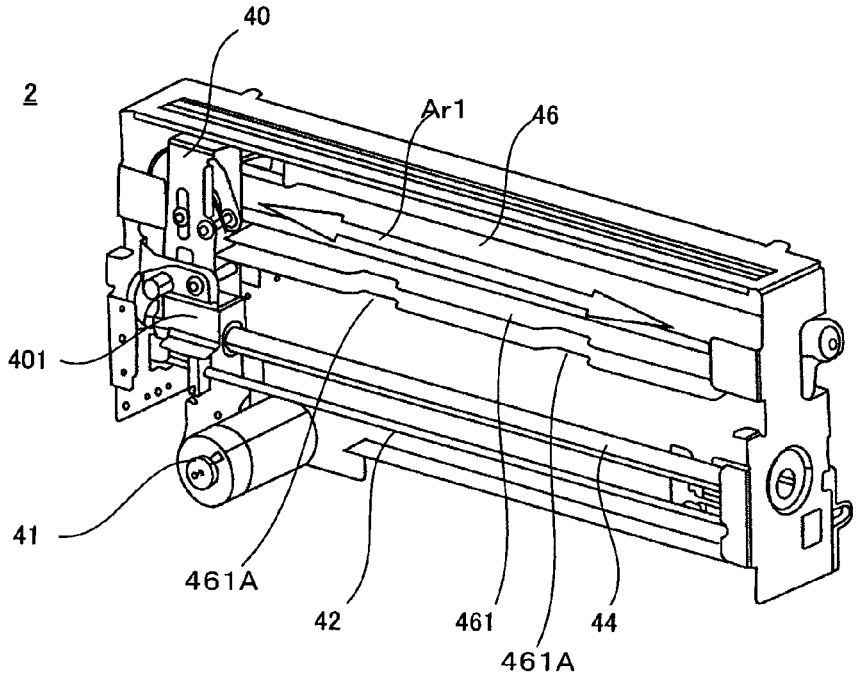
FIG. 3 is an appearance perspective view of a fold-enhancing unit 2.

FIG. 3 is an appearance perspective view of the fold-enhancing unit 2. As shown in FIG. 3, the fold-enhancing unit 2 includes a fold-enhancing roller mechanism 40 having the fold-enhancing roller pair 4, a fold-enhancing unit supporting member 44 that slidably supports the fold-enhancing roller mechanism 40, a timing belt 42 that causes the fold-enhancing roller mechanism 40 to slide, a fold-enhancing motor 41 that drives the timing belt 42, and a carrier guide 46 that guides the sheets of paper in the carrying direction.

The fold-enhancing roller mechanism 40 includes a folding-line-pressurizing mechanism supporting member 401 that slidably mounts the fold-enhancing roller mechanism 40 to the fold-enhancing unit supporting member 44. The fold-enhancing roller mechanism 40 moves in the direction of an arrow Ar1, that is, in the direction orthogonal to the sheet carrying direction, by the timing belt 42 being driven.

The carrier guide 46 includes a pair of flexible members 461 arranged in parallel to the sheet carrying direction so as to face to each other with the sheets of paper pinched therebetween. The flexible members 461 have a function to guide the fold-enhancing rollers 4 to the bundle of sheets of paper. In other words, the fold-enhancing rollers 4 are also capable of enhancing the fold of the thick bundle of sheets of paper without lifting the same by rotating the surfaces of the flexible members 461.

In the saddle unit 103 in the embodiment, the flexible members 461 are formed with notches 461A at stapling positions. Therefore, the flexible members 461 are prevented from being scratches by staple needles of the bundle of sheets, and hence shortening of the life of the component is effectively avoided.

Figure 4:
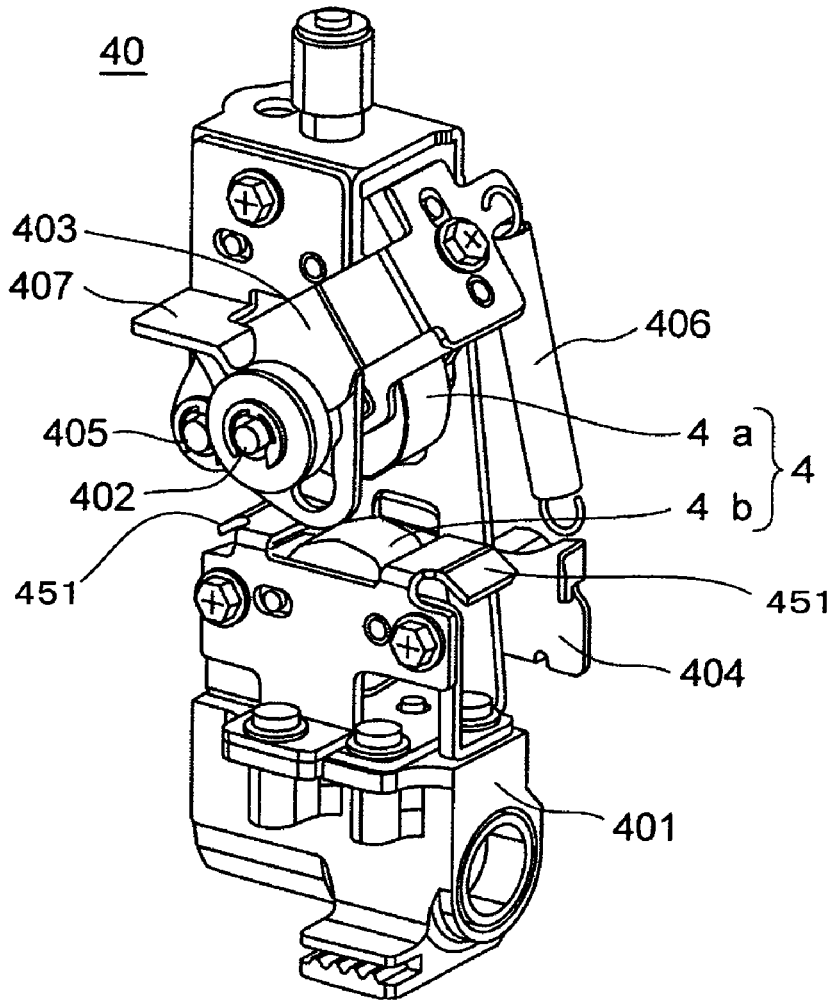
FIG. 4 is an appearance perspective view of a fold-enhancing roller mechanism 40.

FIG. 4 is an appearance perspective view of the fold-enhancing roller mechanism 40. As shown in FIG. 4, the fold-enhancing roller mechanism 40 includes the fold-enhancing roller pair 4 (4*a*, 4*b*).

An upper roller pin 402 rotatably locks the upper fold-enhancing roller 4*a* to an upper link member 403. An upper link pin 405 rotatably locks the upper link member 403 to a carrier guide supporting member 407.

A lower link member 404 rotatably locks the lower fold-enhancing roller 4*b*.

A spring 406 which connects an end of the upper link member 403 and an end of the lower link member 404 pulls the upper link member 403 toward the lower link member 404. The upper fold-enhancing roller 4*a* pinches and pressurizes the sheets of paper with the lower fold-enhancing roller 4*b* by a pulling force of the spring 406.

Figure 5:
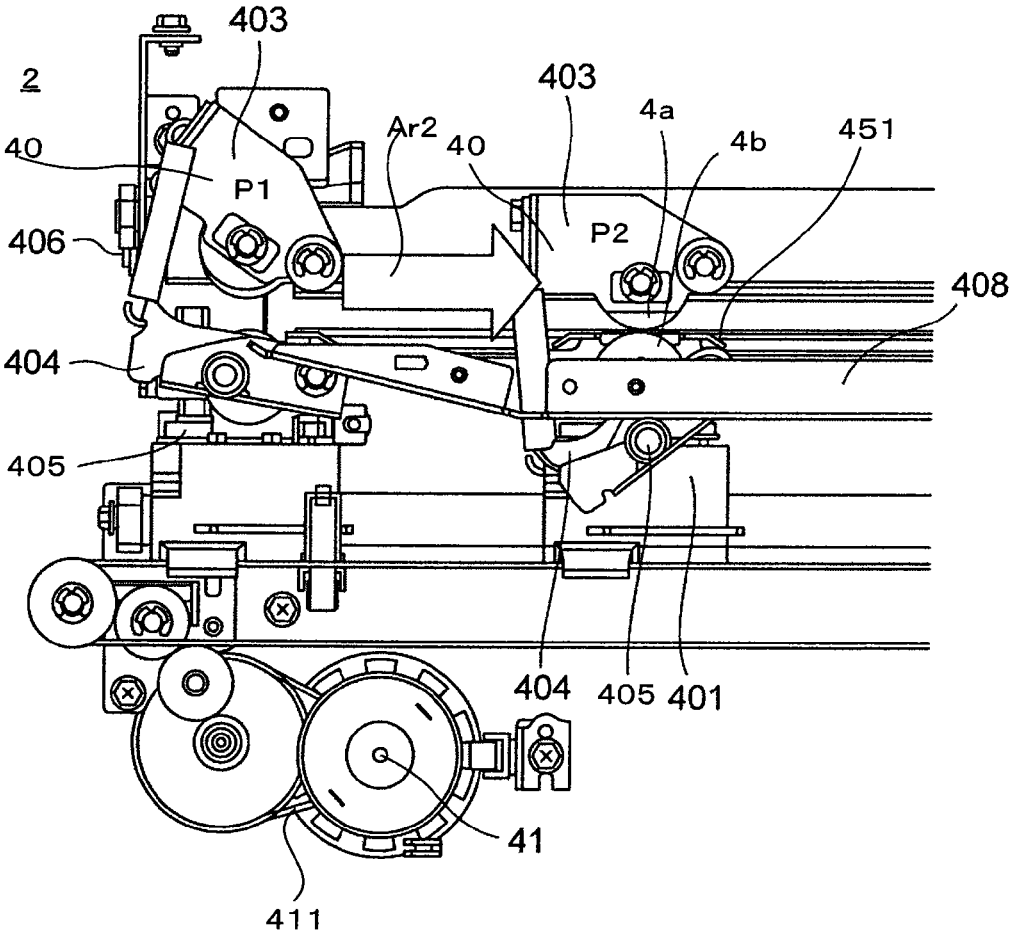
FIG. 5 is a drawing showing a state of movement of the fold-enhancing roller mechanism 40.

FIG. 5 is a drawing showing a state of movement of the fold-enhancing roller mechanism 40. As shown in FIG. 5, the upper fold-enhancing roller 4*a* and the lower fold-enhancing roller 4*b* are apart from each other at a home position P1 of the fold-enhancing roller mechanism 40, and hence there is a clearance at the nip therebetween.

When the fold-enhancing roller mechanism 40 starts to move in the direction indicated by an arrow Ar2, the upper fold-enhancing roller 4*a* moves toward the lower fold-enhancing roller 4*b* at a pressurization starting position P2, and enhances the fold of the sheets of paper together with the flexible members 461. Then, the fold-enhancing roller mechanism 40 continues to move along the fold-enhancing mechanism guide plate 408.

Figure 6:
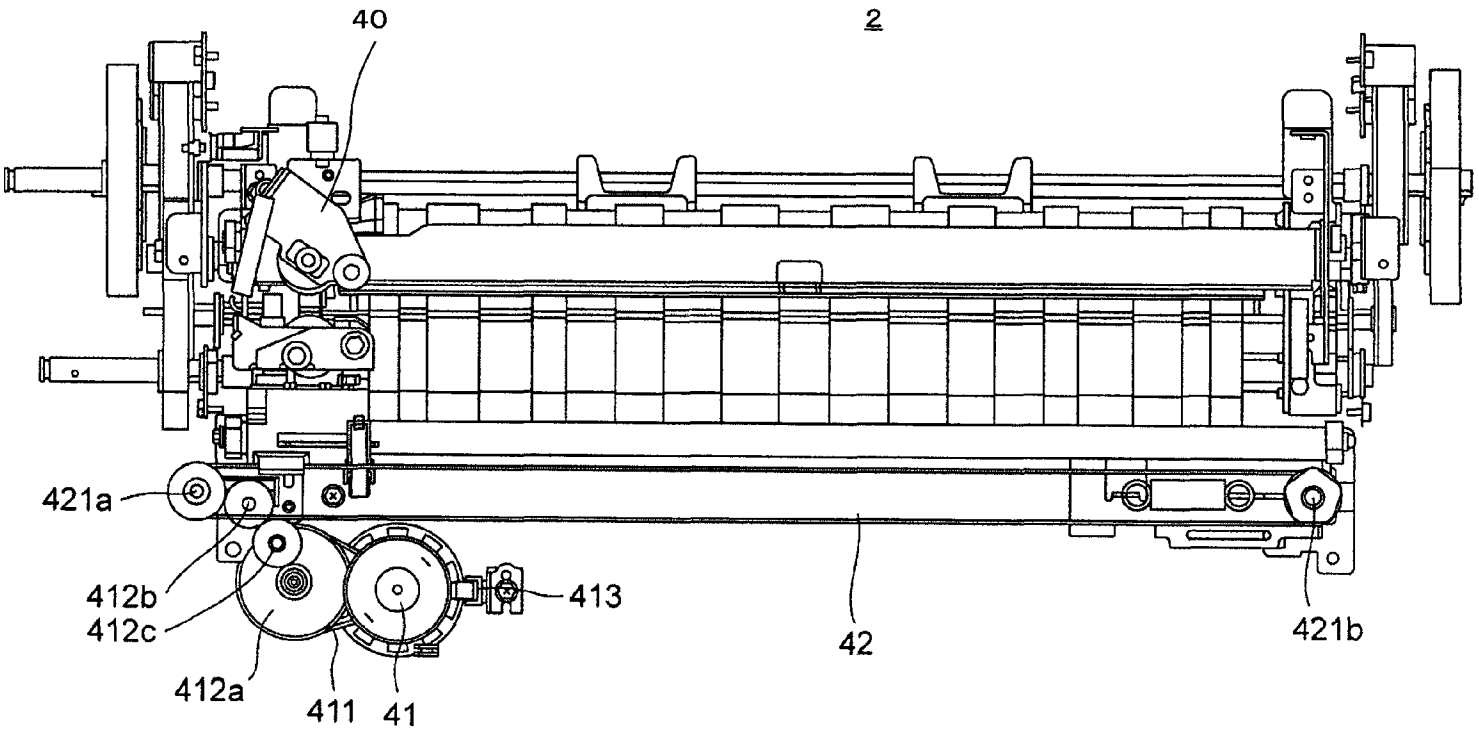
FIG. 6 is a drawing showing a drive unit of the fold-enhancing unit 2.

FIG. 6 is a drawing showing a drive unit of the fold-enhancing unit 2. As shown in FIG. 6, the fold-enhancing unit 2 includes a fold-enhancing motor 41 as a DC motor having an encoder sensor 413, a motor timing belt 411 that transmits a drive force to the fold-enhancing motor 41, and a driven pulley 412*a* and gears 421*a*, 421*b*, 421*c* that transmit the drive force of the motor timing belt 411 to a timing belt 42.

The distance of movement of the fold-enhancing roller mechanism 40 is controlled by output from an encoder sensor 413. When a stepping motor is used instead of the DC motor, the distance of movement of the fold-enhancing roller mechanism 40 is controlled by the number of driven steps.

Figure 7:
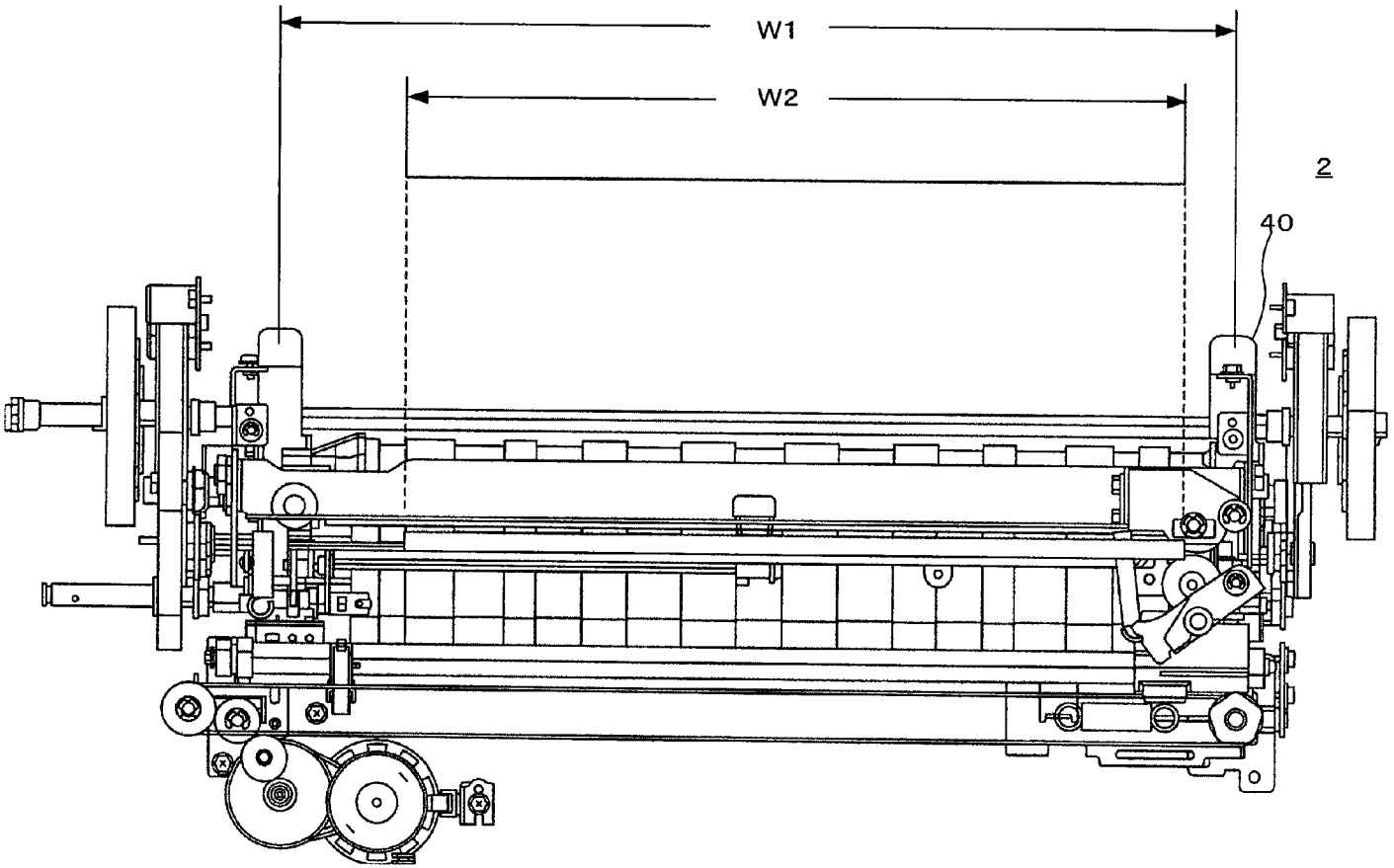
FIG. 7 is a drawing showing a movable range of the fold-enhancing roller mechanism 40.

FIG. 7 is a drawing showing the movable range of the fold-enhancing roller mechanism 40. As shown in FIG. 7, a movable range W1 of the fold-enhancing roller mechanism 40 extends from the home position side to the other end including a maximum width W2 of the sheet of paper which can be treated by the sheet post-processing apparatus.

Figure 8:
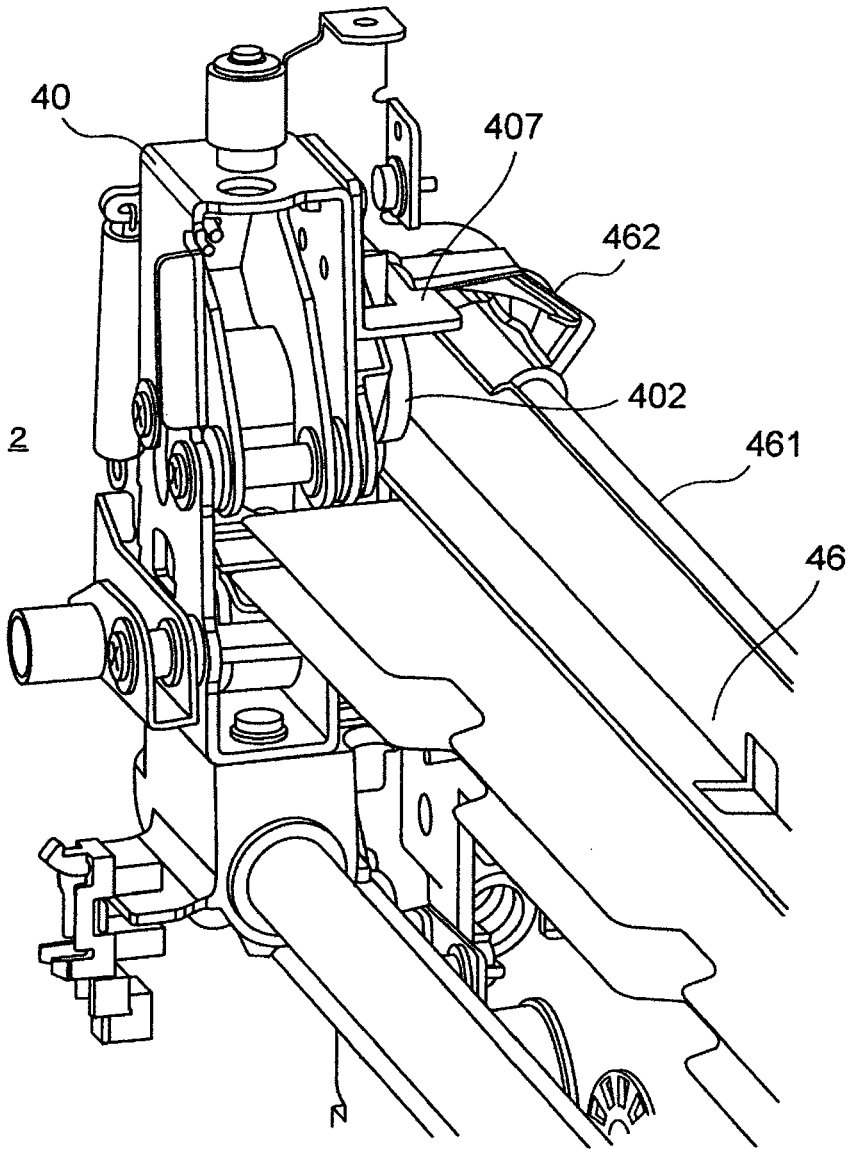
FIG. 8 is an enlarged perspective view of a portion near a home position of the fold-enhancing roller mechanism 40.
Figure 9:
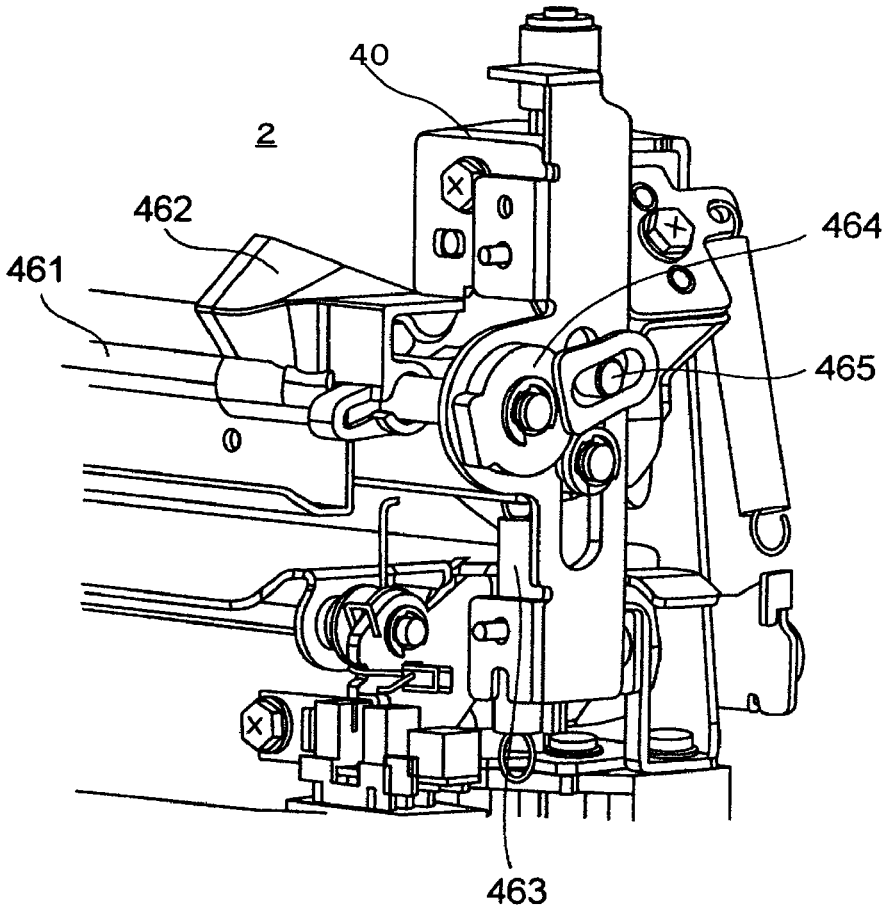
FIG. 9 is an enlarged perspective view of a portion near the home position of the fold-enhancing roller mechanism 40 viewed from the backside.

FIG. 8 is an enlarged perspective view of a portion near a home position of the fold-enhancing roller mechanism 40. FIG. 9 is an enlarged perspective view of a portion near the home position of the fold-enhancing roller mechanism 40 viewed from the backside.

When pressurizing the folded portion of the sheets of paper, the fold-enhancing roller pair 4 moves in the direction orthogonal to the sheet carrying direction to pressurize the sheets of paper. Therefore, there is a possibility that the sheets of paper become damaged due to displacement, winkles, lifting of the sheets of paper or the like.

In order to solve such problem, there is proposed a technology to provide a supporting member to restrain the sheets of paper from moving in the lateral direction provided at the lateral end of the sheets of paper.

However, this technology requires provision of the guide members for each paper size, and hence there arises a problem of increase in manufacturing cost.

In order to solve this problem, according to the saddle unit 103 of the embodiment, the fold-enhancing unit 2 includes the carrier guide 46 so as to move in the vertical direction. The carrier guide 46 is formed of a thin plate member, and pinches and presses the sheets of paper from above and below when the fold-enhancing roller mechanism 40 enhances the fold to prevent displacement or lifting of the sheets of paper.

As shown in FIG. 8 and FIG. 9, the carrier guide 46 includes a shaft 461, a cam member 462, a guide spring 463, a lever member 464, and a bearing member 465. The cam member 462 rotatably connects the shaft 461 which locks the carrier guide 46.

The guide spring 463 pulls the carrier guide 46 in toward the sheets of paper.

When the fold-enhancing roller mechanism 40 is at the home position, the carrier guide supporting member 407 of the fold-enhancing roller mechanism 40 lifts upward and supports the cam member 462 by rotating the same about the shaft 461.

The cam member 462 rotates the shaft 461. Then, the shaft 461 and the lever member 464 that fixes the shaft 461 lift the bearing member 465 locked by the carrier guide 46.

When the fold-enhancing roller mechanism 40 moves from its home position, the carrier guide supporting member 407 is released, and hence the rotation of the cam member 462 and the shaft 461 is allowed, and the guide spring 463 pulls the carrier guide 46 toward the sheets of paper. Then, the carrier guide 46 pressurizes the sheets of paper.

When the fold-enhancing roller mechanism 40 is returned to the home position again after having terminated the fold enhancement, the carrier guide 46 is moved upward again to release the sheets of paper, so that discharge of the sheets of paper is enabled.

As described above, the carrier guide 46 in the embodiment prevents displacement and damage of the sheets of paper without adding another drive unit and without providing supporting members for each paper size, so that improvement of the accuracy of the fold enhancement is effectively achieved.

When the fold-enhancing roller mechanism 40 enhances the fold of the sheets of paper, the upper fold-enhancing roller 4*a* is movable upward. Therefore, even when the bundle of sheets is thick, the upper fold-enhancing roller 4*a* is capable of climbing over the sheets of paper.

However, since the lower fold-enhancing roller 4*b* is fixed to the fold-enhancing roller mechanism 40, there is a possibility of occurrence of paper jam because the fold-enhancing roller pair 4 lifts the sheet of paper when it is thick or when it is sagging.

In view of such problem, as shown in FIG. 4, the fold-enhancing roller mechanism 40 in the embodiment is provided with roller guides 451 which define an opening at the nip between the upper fold-enhancing roller 4*a* and the lower fold-enhancing roller 4*b* so as to cover part of the lower fold-enhancing roller 4*b*. The fold-enhancing roller mechanism 40 includes the roller guides 451 in pair at the front and rear in the direction of advancement of the fold-enhancing roller mechanism 40. The roller guide pair 451 is bent downward at free ends at the front and rear in the direction of advancement of the lower fold-enhancing roller 4*b* as shown in FIG. 4.

In this configuration, the roller guide pair 451 guides the sheets of paper upwardly of the lower fold-enhancing roller 4*b* when the fold-enhancing roller mechanism 40 starts the fold enhancement of the sheets of paper. Therefore, occurrence of the paper jam is effectively prevented.

Control of Operation of Middle-Folding Roller

Figure 10:
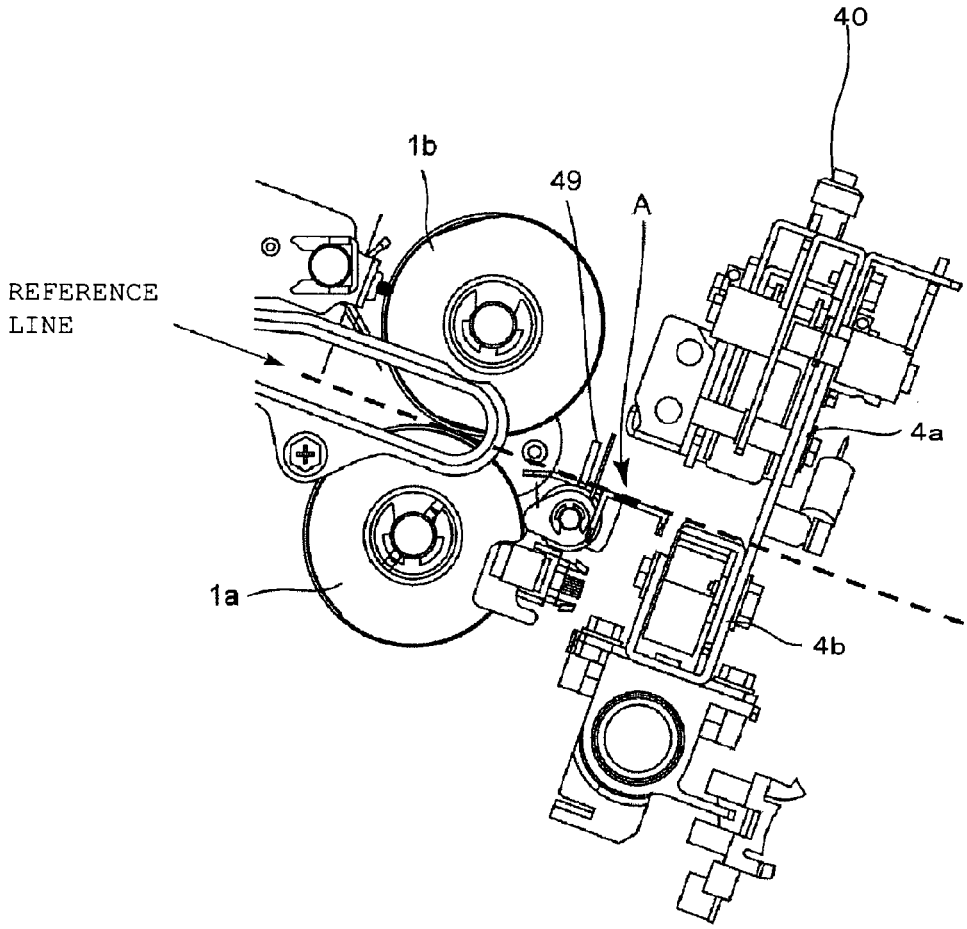
FIG. 10 is an enlarged side view of the middle-folding roller 1 and the fold-enhancing roller mechanism 40.

FIG. 10 is an enlarged side view of the middle-folding roller pair 1 and the fold-enhancing roller mechanism 40.

As shown in FIG. 10, a lower middle-folding roller 1*a* and the lower fold-enhancing roller 4*b* are set in such a manner that the outer peripheral surfaces thereof are positioned at a level lower than a reference line which is the center of the thickness of the booklet formed by folding the sheets of paper in the carrying direction.

In this configuration, occurrence of the paper jam is prevented when the saddle unit 103 folds the sheets of paper to form the booklet.

Figure 11:
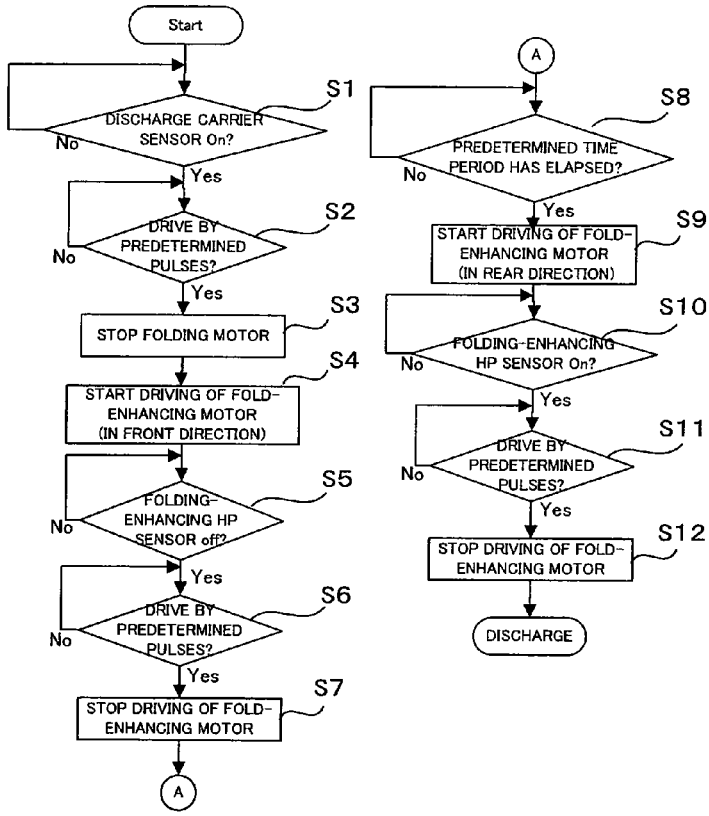
FIG. 11 is a flowchart showing an operation of the fold enhancement performed by the saddle unit 103.
Figure 12:
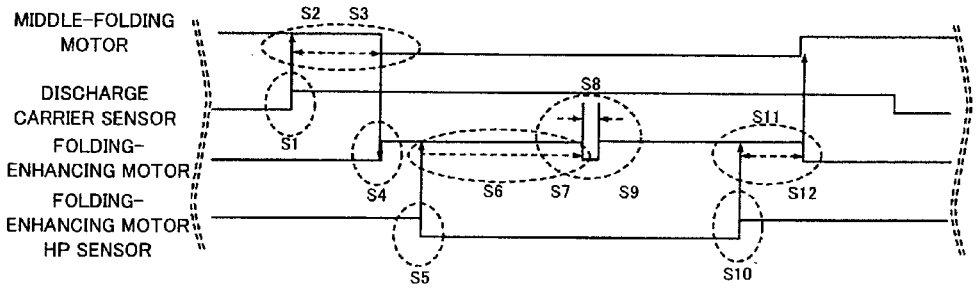
FIG. 12 is a timing chart showing the operation of the fold enhancement performed by the saddle unit 103.

FIG. 11 is a flowchart showing an operation of the fold enhancement performed by the saddle unit 103. FIG. 12 is a timing chart showing the operation of the fold enhancement performed by the saddle unit 103. Reference signs in FIG. 12 correspond to the reference sign in FIG. 11.

When the middle-folding blade 3 pushes the sheets of paper into the middle-folding roller pair 1, the sheets of paper folded in the middle turn a discharge carrier sensor 49 shown in FIG. 11 ON.

In Step S1, the saddle unit 103 determines whether the discharge carrier sensor 49 is ON or not. When the discharge carrier sensor 49 is ON, the saddle unit 103 goes to Step S2. When the discharge carrier sensor 49 is not ON, the saddle unit 103 goes back to Step S1.

In Step S2, the saddle unit 103 counts pulses from the encoder and determines whether a middle-folding motor, which drives the middle-folding rollers 1, has driven by predetermined pulses or not. When the middle-folding motor has driven by the predetermined pulses, the saddle unit 103 goes to Step S1. When the middle-folding motor has not driven by the predetermined pulses, the saddle unit 103 returns to Step S2.

In Step S3, the saddle unit 103 stops the middle-folding motor.

In Step S4, the saddle unit 103 causes the fold-enhancing motor 41 to drive in the forward direction.

In Step S5, the saddle unit 103 determines whether the fold-enhancing HP sensor, which detects whether the fold-enhancing roller mechanism 40 is at the home position or not, is ON or not. When the fold-enhancing HP sensor is ON, the saddle unit 103 returns to Step S5. When the fold-enhancing HP sensor is not ON, that is, when the fold-enhancing roller mechanism 40 is deviated from the home position, the saddle unit 103 goes to Step S6.

In Step S6, the saddle unit 103 determines whether the fold-enhancing motor 41 has driven by the predetermined steps or not. When the fold-enhancing motor 41 has driven the predetermined steps, the saddle unit 103 goes to Step S7. When the fold-enhancing motor 41 has not driven the predetermined steps, the saddle unit 103 returns back to Step S6.

In Step S7, the saddle unit 103 stops driving of the fold-enhancing motor 41.

In Step S8, the saddle unit 103 determines whether the predetermined time period has elapsed or not. When the predetermined time period has not elapsed, the saddle unit 103 returns to Step S8. When the predetermined time period has elapsed, the saddle unit 103 goes to Step S9.

In Step S9, the saddle unit 103 causes the fold-enhancing motor 41 to start driving backward.

In Step S10, the saddle unit 103 determines whether the fold-enhancing HP sensor is ON or not. When the fold-enhancing HP sensor is not ON, the saddle unit 103 goes back to Step S10. When the fold-enhancing HP sensor is ON, the saddle unit 103 goes to Step S11.

In Step S11, the saddle unit 103 determines whether the fold-enhancing motor 41 has driven by the predetermined steps. When the fold-enhancing motor 41 has driven by the predetermined steps, the saddle unit 103 goes to Step S12. When the fold-enhancing motor 41 has not driven by the predetermined steps, the saddle unit 103 goes back to Step S11.

In Step S12, the saddle unit 103 stops driving of the fold-enhancing motor 41.

As shown in FIG. 12, the saddle unit 103 stops the middle-folding motor and causes the fold-enhancing motor 41 to drive.

Figure 13:
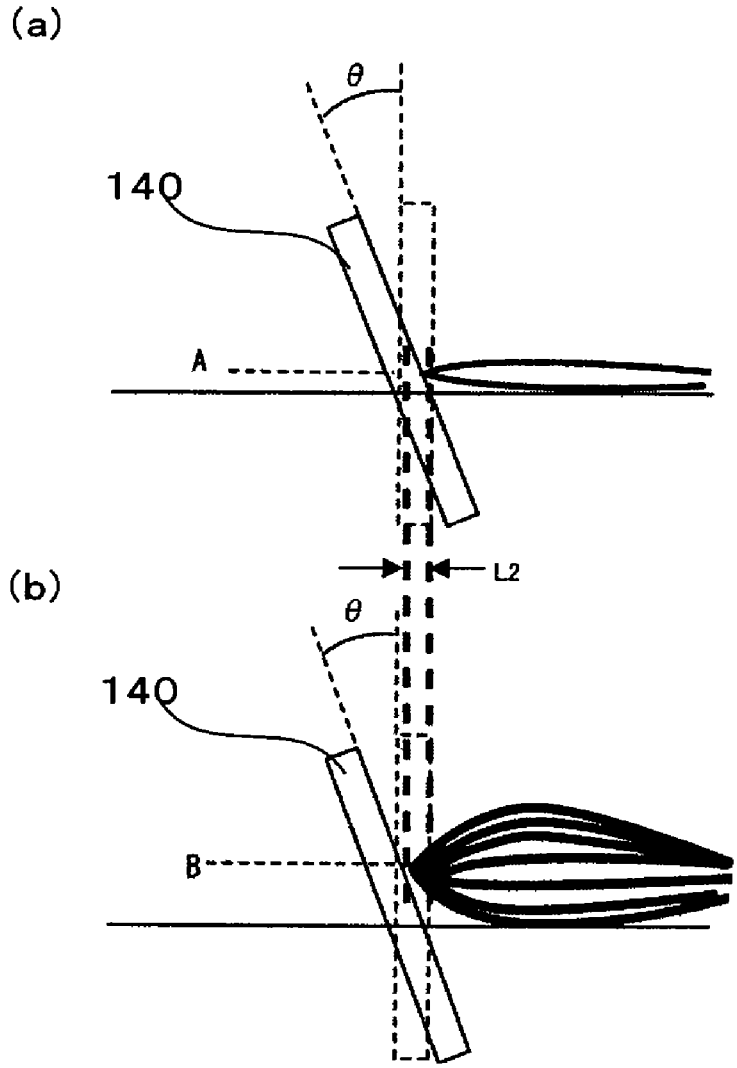
FIG. 13 is a drawing showing the movement of a discharge carrier sensor 49.

FIG. 13 is a drawing showing the movement of the discharge carrier sensor 49. More specifically, FIG. 13 is a drawing showing the movement of the discharge carrier sensor 49 in Step S1 to Step S3 in FIG. 11.

In Step S1 in FIG. 11, when the sheets of paper turns the discharge carrier sensor 49 ON, if a sensor of a mechanical actuator type is used as the discharge carrier sensor 49, an angle at which the discharge carrier sensor 49 is turned ON is designated as θ.

FIG. 13(*a*) shows a case in which the bundle of sheets is thin, and FIG. 13(*b*) shows a case in which the bundle of sheets is thick. When the bundle of sheets is thin, a contact point of the bundle of sheets with respect to an actuator 140 is A. In contrast, when the bundle of sheets is thick, a contact point of the bundle of sheets with respect to the actuator 140 is B.

Figure 14:
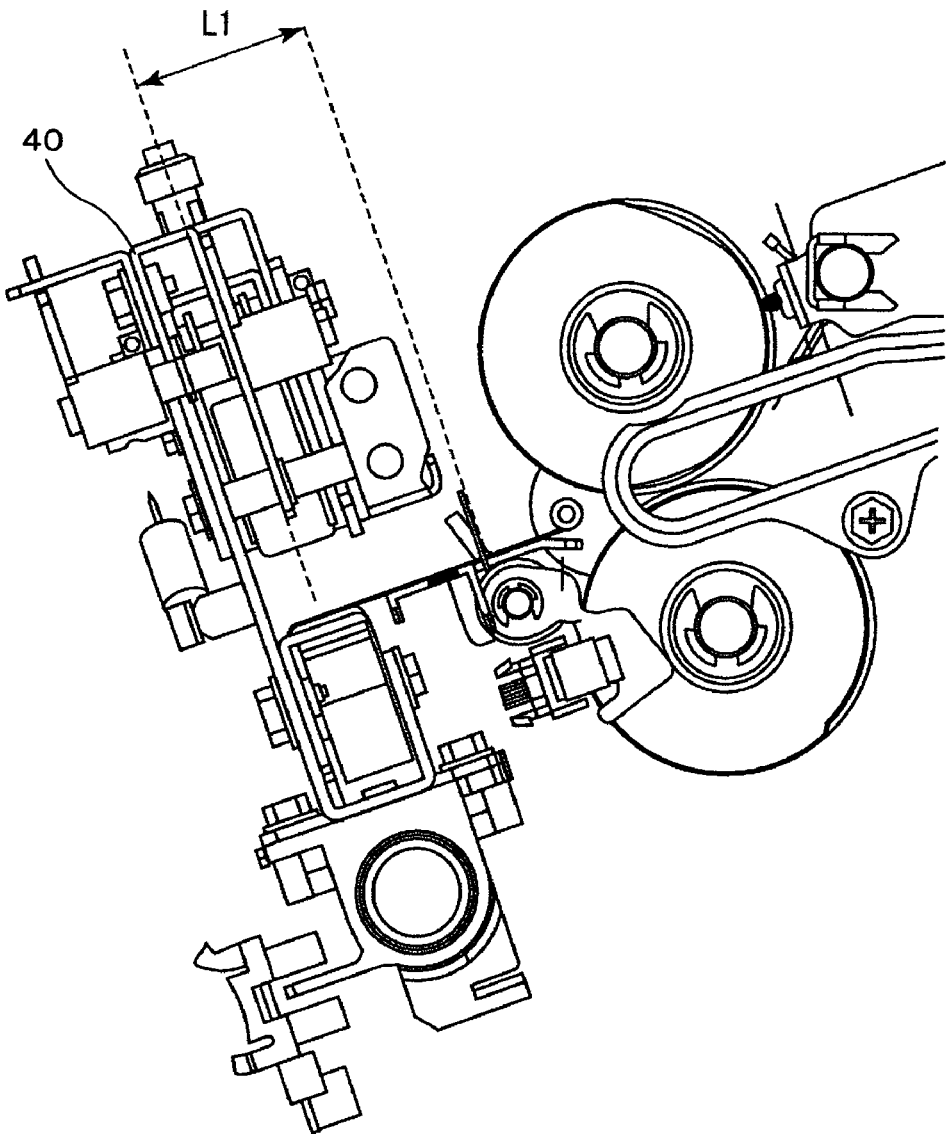
FIG. 14 is a cross-sectional view of the fold-enhancing roller mechanism 40.

FIG. 14 is a cross-sectional view of the fold-enhancing roller mechanism 40. As shown in FIG. 14, in Step S2 in FIG. 11, the distance from the ON position of the discharge carrier sensor 49 to the position where the leading edge of the sheets of paper to be folded in the middle stops in Step S1 is designated by L1. At this time, when the sheets of paper are carried by the number of pulses corresponding to L1, there is a probability that the stop position of the sheets of paper is deviated by a length corresponding to an error L2 at the time detected by the sensor shown in FIGS. 13A and 13B when the bundle of sheets is thick.

In view of such problem, the sheet post-processing apparatus in the embodiment performs a control as follows. The saddle unit 103 stores the number of sheets of paper to be treated. When the number of sheets of paper stacked for the bundle of sheets is increased, the saddle unit 103 reduces the number of feeding pulses, which is a predetermined number of pulses in Step S2 in FIG. 11, correspondingly.

In this manner, the saddle unit 103 changes the length of the sheets of paper to be discharged from the middle-folding roller pair 1 toward the fold-enhancing unit according to the number of stacked sheets of paper.

As described thus far, in the sheet post-processing apparatus in this embodiment, the saddle unit 103 changes the number of feeding pulses according to the number of the sheets of paper to be treated by the saddle unit 103. Therefore, the accuracy of the fold enhancement is effectively increased.

Subsequently, countermeasure for a load from staple needles to the fold-enhancing rollers 4 will be described. When the bundle of sheets is thin such as a case in which the bundle of sheets includes only several sheets of paper, the load from the staple needles on the bundle of sheets concentrates portions of the fold-enhancing rollers 4. Consequently, there is a problem such that these portions are scraped and hence the life of the component is shortened. Probability of occurrence of this problem increases with increase in accuracy of the fold enhancement.

In view of such problem, according to the sheet post-processing apparatus in the embodiment, the saddle unit performs the control as follows.

Figure 15:
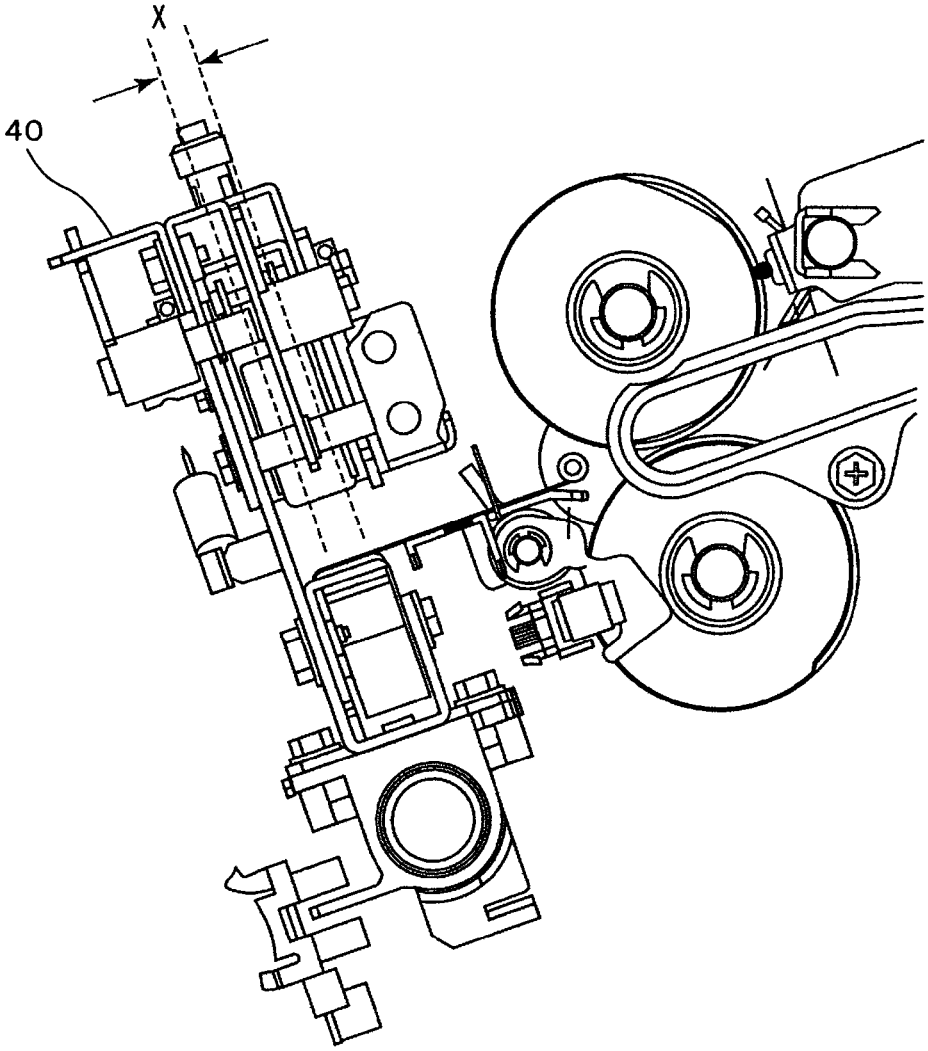
FIG. 15 is a cross-sectional view of the fold-enhancing roller mechanism 40.
Figure 16:
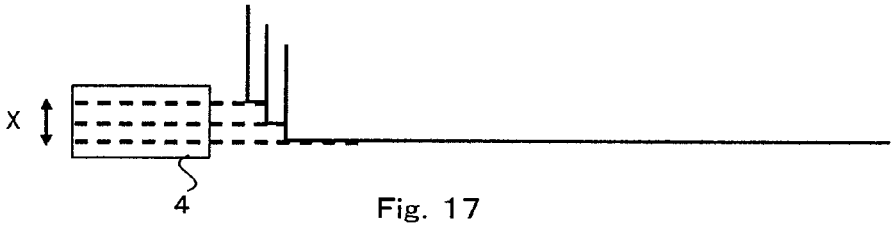
FIG. 16 shows the fold-enhancing roller pair 4 and the position of the fold enhancement.

FIG. 15 is a cross-sectional view of the fold-enhancing roller mechanism 40. FIG. 16 shows the fold-enhancing roller 4 and the position of the fold enhancement. As shown in FIG. 15 and FIG. 16, the fold-enhancing roller pair 4 has a range X in which the fold enhancement is possible, and it is not necessary to pressurize the sheets of paper always at the same position.

Therefore, the saddle unit 103 in the embodiment controls the number of feed pulses, so that the position of fold enhancement, which corresponds to the position where the sheets of paper are stopped for the fold enhancement, is changed for each bundle of sheets which is subjected to the fold enhancement within the width of the fold-enhancing rollers 4 and within the width effective for performing the fold enhancement process.

Figure 17:
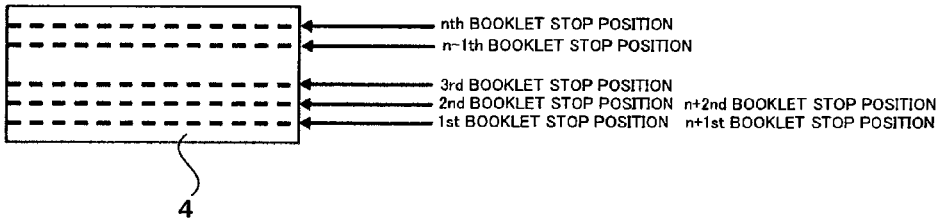
FIG. 17 is a drawing showing a first control method.

FIG. 17 is a drawing showing a first control method. The saddle unit 103 stores the number of feed pulses for each bundle of sheets which is subjected to the fold enhancement. As shown in FIG. 17, the saddle unit 103 subtracts the number of feed pulses by a constant value for each bundle of sheets, and the position of fold enhancement is shifted to a predetermined number of bundles of sheets n.

The saddle unit 103 resets the number of feed pulses to a predetermined value, and the fold of the $n+1^{st}$ bundle of sheets is enhanced at the position of fold enhancement for the first bundle of sheets. The saddle unit 103 changes the position of fold enhancement by repeated this operation from then on.

Figure 18:
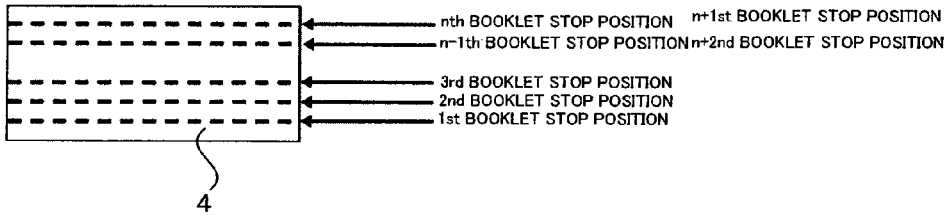
FIG. 18 is a drawing showing a second control method.

FIG. 18 is a drawing showing a second control method. The saddle unit 103 stores the number of feed pulses for each bundle of sheets which is subjected to the fold enhancement. As shown in FIG. 18, the saddle unit 103 subtracts the number of feed pulses by a constant value for each bundle of sheets, and the position of the fold enhancement is shifted to a predetermined number of bundles of sheets n.

Subsequently, the saddle unit 103 adds the number of feed pulses by a certain value for each bundle of sheets, and the position of fold enhancement is shifted to a predetermined number of bundles of sheets 2*n*. The saddle unit 103 changes the position of fold enhancement by repeating this operation from then on.

In this configuration, the saddle unit 103 is effectively able to prevent local abrasion of the fold-enhancing roller 4 while improving the accuracy in fold enhancement.

Figure 19:
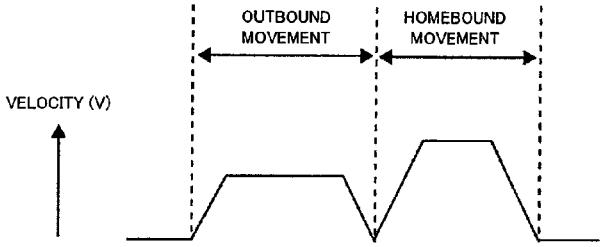
FIG. 19 is a timing chart showing the velocity of movement of the fold-enhancing roller mechanism 40 at the time of fold enhancement.

FIG. 19 is a timing chart showing the velocity of movement of the fold-enhancing roller mechanism 40 at the time of fold enhancement. As shown in FIG. 19, the saddle unit 103 in the embodiment is adapted in such a manner that the homebound velocity, which is the movement from the terminal position to the home position, is faster than the outbound velocity, which is the movement from the home position of the fold-enhancing roller mechanism 40 to the terminal position, which is the position of the limit of movement toward the other end of the fold-enhancing unit 2.

In this operation, the time required for the homebound movement is reduced while preventing lifting or twisting.

(Control of Movement of Fold-Enhancing Roller)

In the saddle unit in the related art, the fold enhancement is done by a specified number of times or a specified number of times according to the number of the sheets to be treated.

Therefore, a user is not able to reduce the number of times of fold enhancement for the sake of process time period, or to increase the number of times of fold enhancement for stronger fold enhancement.

Therefore, the saddle unit 103 in the embodiment is adapted in such a manner that the user is able to specify the fold-enhancing operation of the fold-enhancing roller mechanism 40, and the reciprocating movement is employed in the fold-enhancing operation of the fold-enhancing roller mechanism 40, so that the fold enhancement which further satisfies user's requirements is enabled.

Figure 20:
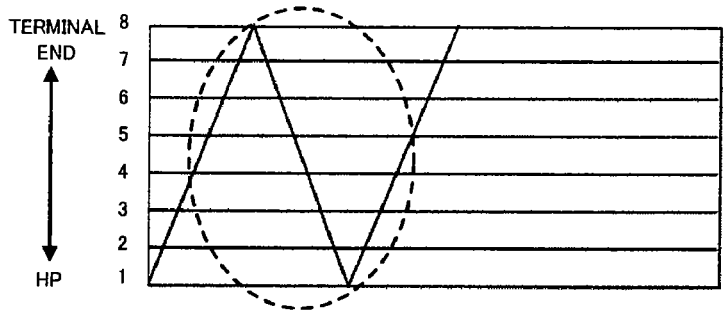
FIG. 20 is a graph showing a normal pattern of movement of the fold-enhancing roller mechanism 40.

FIG. 20 is a graph showing a normal pattern of movement of the fold-enhancing roller mechanism 40. The vertical axis represents the distance from the home position to the fold-enhancing roller mechanism 40. The lateral axis represents the time.

As shown in FIG. 20, in the normal pattern, the fold-enhancing roller mechanism 40 simply reciprocates between the home position and the terminal position. When the bundle of sheets is thin, the time period required for the fold enhancement is shortened in the normal pattern.

Figure 21:
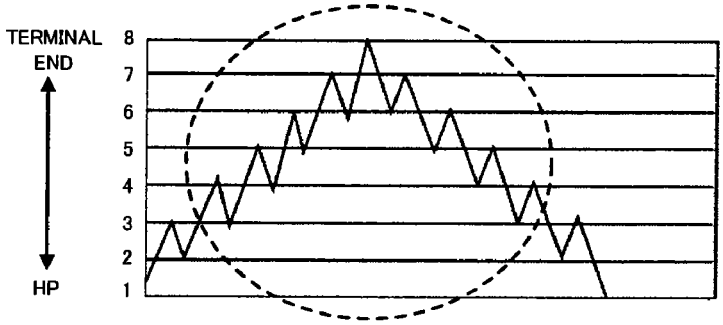
FIG. 21 is a graph showing a first pattern including the reciprocating movement of the fold-enhancing roller mechanism 40.

FIG. 21 is a graph showing a first pattern including the reciprocating movement of the fold-enhancing roller mechanism 40. The vertical axis represents the distance from the home position to the fold-enhancing roller mechanism 40. The lateral axis represents the time. As shown in FIG. 21, the first pattern includes the reciprocating movement both in the homebound movement and the outbound movement.

The reciprocating movement will now be described. The reciprocating movement represents a method of moving in which the direction of movement is changed without being positioned at the home position nor the terminal position. In the interior of a circle indicated by dotted line in FIG. 21, for example, a method of moving from a position 3 in the vertical axis to a position 5 in the vertical axis, and then changing the direction of movement and moving to a position 4 in the vertical axis is the reciprocating movement because the device is not positioned at the home position nor the terminal position.

Figure 22:
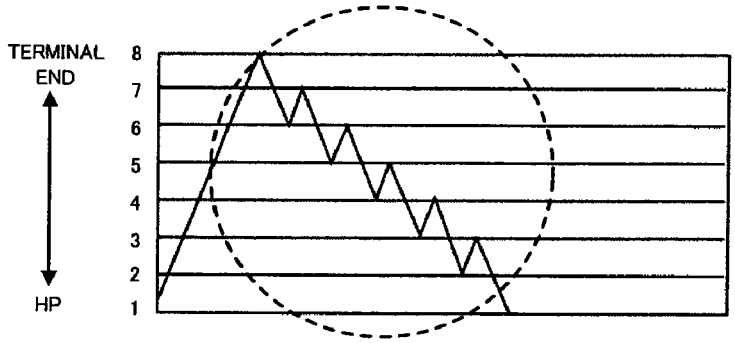
FIG. 22 is a graph showing a second pattern including the reciprocating movement of the fold-enhancing roller mechanism 40.

FIG. 22 is a graph showing a second pattern including the reciprocating movement of the fold-enhancing roller mechanism 40. The vertical axis represents the distance from the home position to the fold-enhancing roller mechanism 40. The lateral axis represents the time. The second pattern includes the reciprocating movement either in the outbound movement or in the homebound movement. FIG. 22 shows a pattern including the reciprocating movement only in the homebound movement. However, it is also possible to include the reciprocating movement only in the outbound movement.

Figure 23:
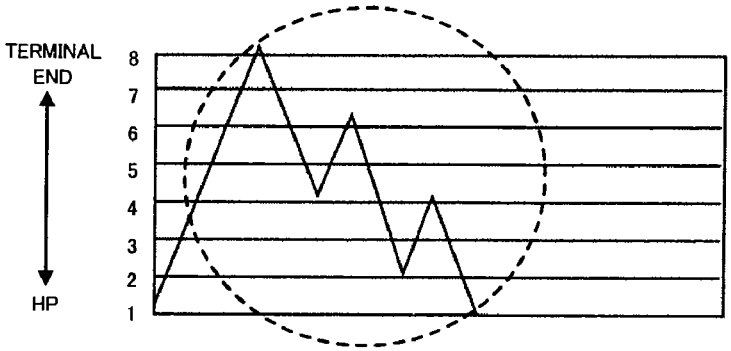
FIG. 23 is a graph showing a third pattern including the reciprocating movement of the fold-enhancing roller mechanism 40.

FIG. 23 is a graph showing a third pattern including the reciprocating movement of the fold-enhancing roller mechanism 40. The vertical axis represents the distance from the home position to the fold-enhancing roller mechanism 40. The lateral axis represents the time.

As shown in FIG. 23, the third pattern includes only one reciprocating movement. In this manner, the number of reciprocating movements may be set as needed.

The saddle unit 103 is able to be adapted to control the movement of the fold-enhancing roller mechanism 40 by determining the optimum pattern and velocity of movement of the fold-enhancing roller mechanism 40 from the number of stacked sheets of paper, the paper size and the paper thickness to be subjected to the fold enhancement.

For example, when the number of stacked sheets of paper is equal to or larger than a certain threshold value and the thickness of the sheet of paper is equal to or larger than a certain threshold value, the saddle unit 103 selects the first pattern, sets the velocity to a low velocity, and sets the range of movement of the fold-enhancing roller mechanism 40 according to the size of the sheets of paper, so that the movement of the fold-enhancing roller mechanism 40 is controlled.

Alternatively, when the number of stacked sheets of paper is smaller than the certain threshold value and the thickness of the sheet of paper is smaller than the certain threshold value, the saddle unit 103 selects the third pattern, sets the velocity to a high velocity, and sets the range of movement of the fold-enhancing roller mechanism 40 according to the size of the sheets of paper, so that the movement of the fold-enhancing roller mechanism 40 is controlled.

Furthermore, the saddle unit 103 of the sheet post-processing apparatus in the embodiment may be configured in such a manner that the movement pattern of the fold-enhancing roller mechanism 40 is changeable by the selection of the user.

In this case, the saddle unit 103 includes a control device having a CPU and a memory, and receives entry of information relating to the fold enhancement from the control device or an operation panel (control panel, not sown) of the image forming apparatus 101.

The saddle unit 103 may be configured to accept the entry of the information relating to the fold enhancement from a personal computer connected to the control unit of the saddle unit via the image forming apparatus. Acceptance of entry of information relating to the fold enhancement and setting an action corresponding thereto is referred to as "Job setting".

The information relating to the fold enhancement may include the number of times of fold enhancement, the number of times of reciprocating movement, the paper size, the paper type, and level of the quality of fold enhancement, but it is not limited thereto, and some of these items may be omitted.

The saddle unit 103 may be configured to store some pattern in a table and read out a pattern which complies with the entered conditions for determination.

In this case, a configuration in which modification and elimination of this table and modification and elimination of the determination conditions are done on the basis of the Job setting information of the personal computer connected to the saddle unit 103 via the image forming apparatus is also applicable.

Figure 24:
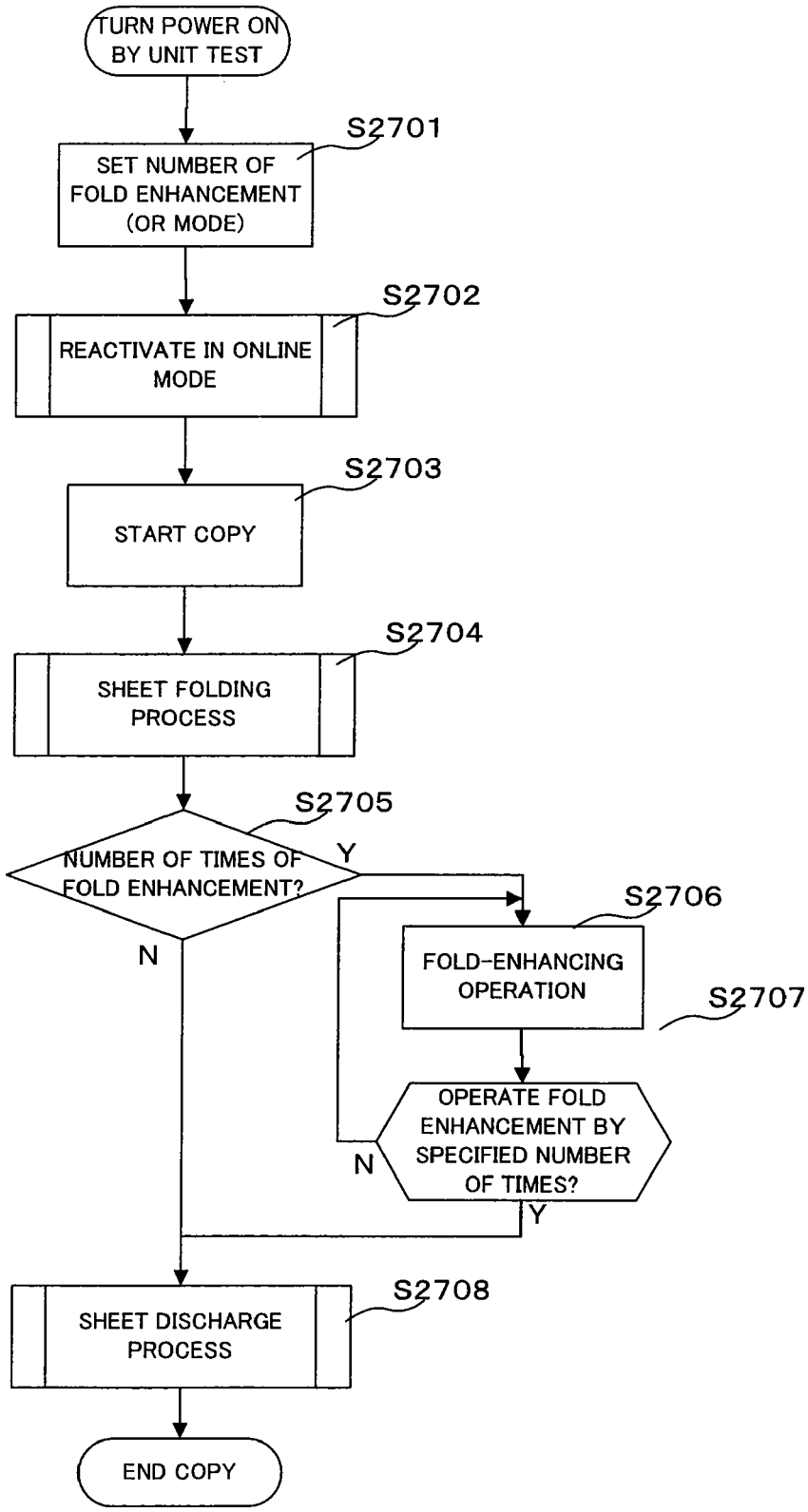
FIG. 24 is a flowchart showing a procedure of setting of the pattern of fold enhancement at the time of a unit test of the saddle unit 103.

FIG. 24 is a flowchart showing a procedure of setting of the pattern of fold enhancement at the time of a unit test of the saddle unit 103.

As shown in FIG. 24, the saddle unit 103 is activated in the unit test mode.

Then, in Step S2701, the saddle unit 103 performs setting by accepting the entry of information relating to the fold enhancement such as the number of times of fold enhancement and quality mode, and storing the same in the memory.

In Step S2702, the saddle unit 103 is reactivated in an online mode with the image forming apparatus.

In Step S2703, the saddle unit 103 receives a signal indicating that copying operation is started from the image forming apparatus.

In Step S2704, the saddle unit 103 performs middle-folding of the sheets of paper received from the image forming apparatus.

In Step S2705, the saddle unit 103 determines whether to perform the fold enhancement or not. When the fold enhancement is not performed, the saddle unit 103 proceeds to Step S2708, and when performing the fold enhancement, the procedure goes to Step S2706.

In Step S2706, the saddle unit 103 drives the fold-enhancing roller mechanism 40.

In Step S2707, the saddle unit 103 determines whether the set number of times of fold enhancement is terminated or not. When the set number of times of fold enhancement is terminated, the saddle unit 103 proceeds to Step S2708, and when the set number of fold enhancement is not terminated, the saddle unit 103 goes back to Step S2706.

In Step S2708, the saddle unit 103 discharges the sheets of paper and terminates copying.

Figure 25:
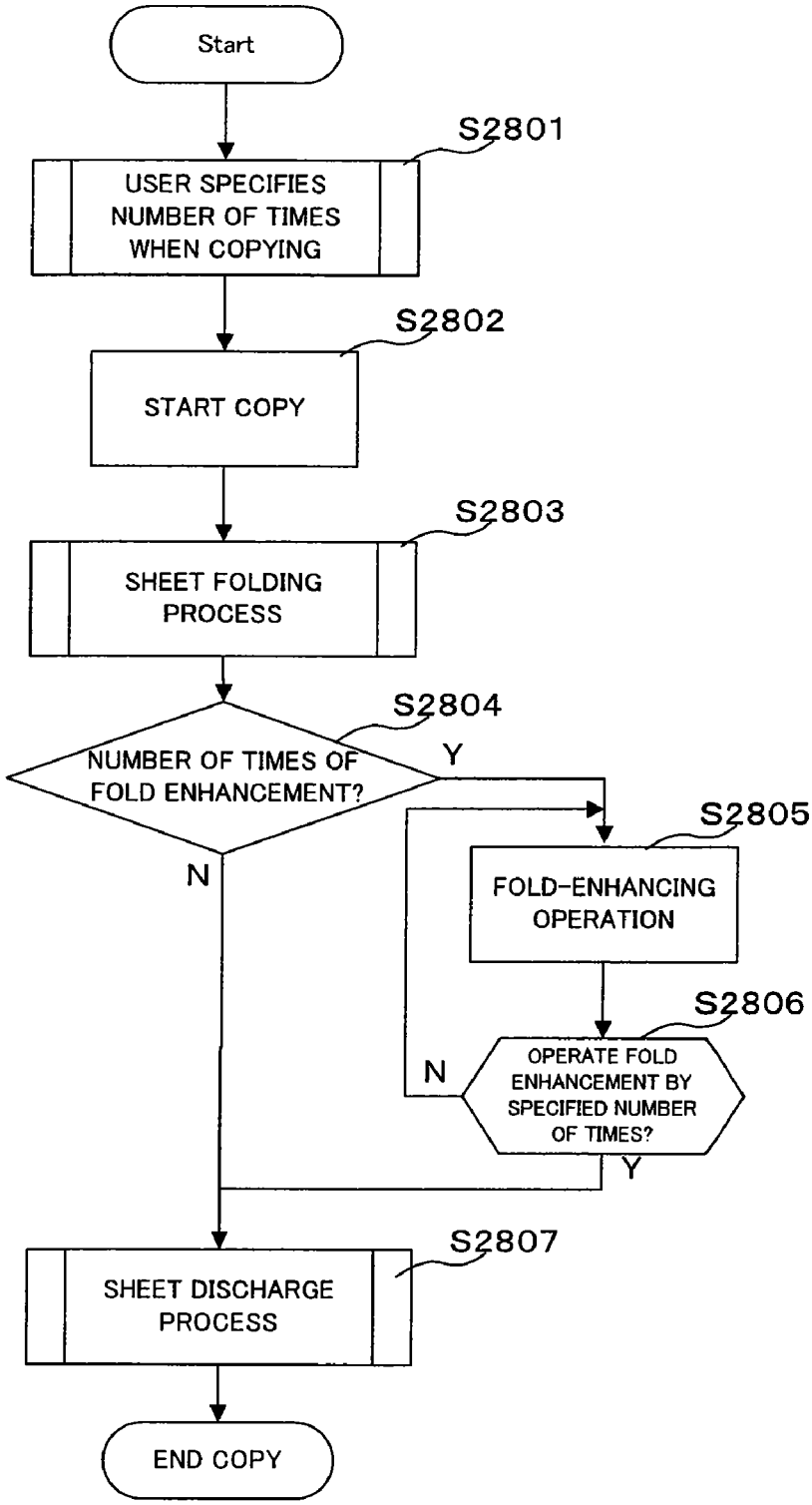
FIG. 25 is a flowchart showing a procedure of setting of the fold-enhancing pattern of the saddle unit 103 on-line.

FIG. 25 is a flowchart showing a procedure of setting of the fold-enhancing pattern of the saddle unit 103 on-line.

As shown in FIG. 25, the saddle unit 103 is activated in the online mode.

In Step S2801, the saddle unit 103 performs the setting by accepting entry of the information relating to the fold enhancement such as the number of times of fold enhancement or the quality mode from the control panel of the image forming apparatus or the control device of the image forming apparatus, and storing in the memory.

In the Step S2802, the saddle unit 103 receives a signal indicating that the copying operation is started from the image forming apparatus.

In Step S2803, the saddle unit 103 performs the middle-folding for the sheets of paper received from the image forming apparatus.

In Step S2804, whether the saddle unit 103 performs the fold enhancement or not is determined. The saddle unit 103 goes to Step S2807 not to perform the fold enhancement, and goes to Step S2805 to perform the fold enhancement.

In Step S2805, the saddle unit 103 drives the fold-enhancing roller mechanism 40.

In Step S2806, the saddle unit 103 determines whether the set number of times of fold enhancement is terminated or not. When the set number of times of fold enhancement is terminated, the saddle unit 103 goes to Step S2807, and when the set number of times of fold enhancement is not terminated, the saddle unit 103 goes back to Step S2805.

In Step S2807, the saddle unit 103 discharges the sheets of paper, and terminates the copying operation.

As described thus far, the saddle unit 103 of the sheet post-processing apparatus in the embodiment includes the reciprocating movement in the movement pattern of the fold-enhancing roller mechanism 40, and determines and controls the presence or absence, the number of times, the velocity, and the range of the reciprocating movement. Therefore, the saddle unit 103 has an effect that the fold enhancement can be performed at a high degree of accuracy in a short time according to the number of stacked sheets of paper, the paper thickness and the paper size.

(Jam Release Mechanism of Fold-Enhancing Unit)

Figure 26:
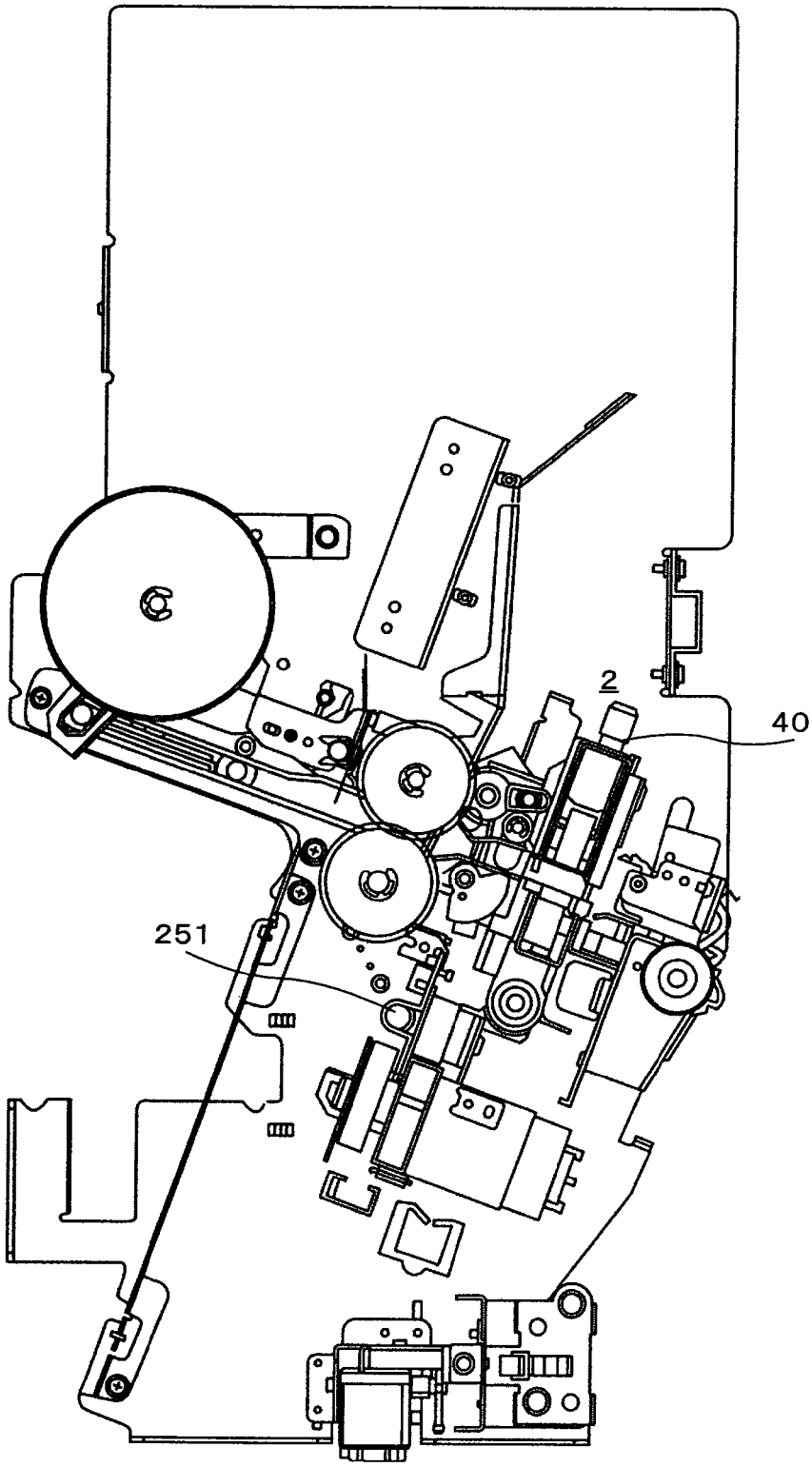
FIG. 26 is a side cross-sectional view showing the sheet post-processing apparatus in the embodiment shown with the saddle unit 103.

Subsequently, the jam release mechanism of the fold-enhancing unit 2 will be described. FIG. 26 is a side cross-sectional view showing the sheet post-processing apparatus in the embodiment shown with the saddle unit 103.

As shown in FIG. 26, the fold-enhancing unit 2 is locked to the saddle unit 103 via a pivot pin 251 so as to be capable of rotating in the sheet carrying direction and opening sufficiently for removing jammed paper. FIG. 26 shows a state in which the fold-enhancing unit 2 is closed.

Figure 27:
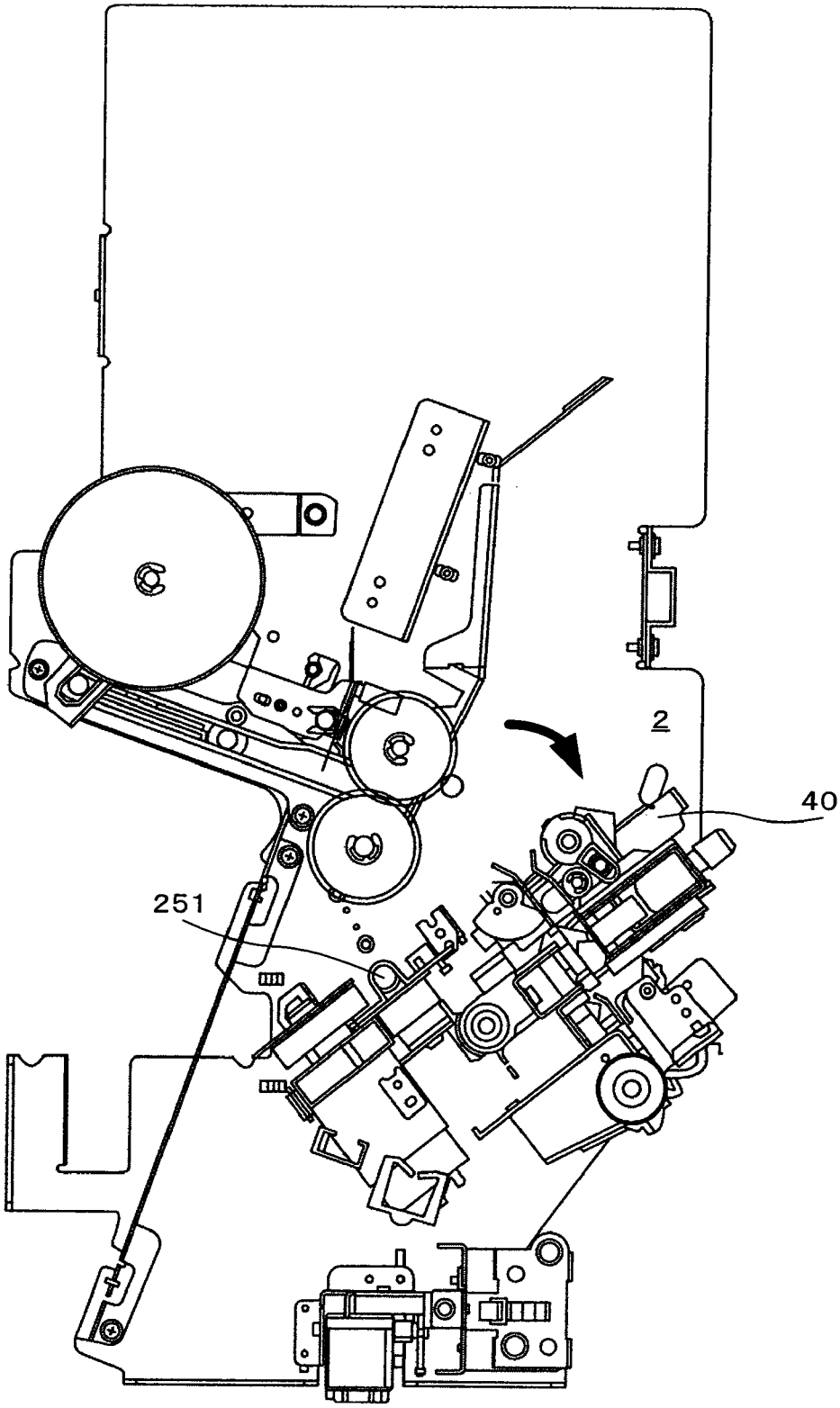
FIG. 27 is a drawing showing a state in which the fold-enhancing unit 2 is opened.

FIG. 27 is a drawing showing a state in which the fold-enhancing unit 2 is opened. As shown in FIG. 27, the fold-enhancing unit 2 opens by rotating in the sheet carrying direction about the pivot pin 251.

Here, although a mechanism to open the fold-enhancing unit 2 in the direction orthogonal to the sheet carrying direction is also conceivable, a space for allowing the fold-enhancing unit 2 to rotate above or below the fold-enhancing unit 2 is required within the saddle unit 103 in this case.

In contrast, in the embodiment, since the fold-enhancing unit 2 is attached to the saddle unit 103 so as to rotate in the sheet carrying direction, the space for allowing the fold-enhancing unit 2 to rotate to be provided within the saddle unit may be small.

As described thus far, the saddle unit 103 of the sheet post-processing apparatus in the embodiment locks the fold-enhancing unit 2 so as to be rotatable in the sheet carrying direction by the pivot pin 251. Therefore, there is an effect that the space for attaching the fold-enhancing unit 2 may be smaller than that in the mechanism in which the fold-enhancing unit 2 opens in the direction orthogonal to the sheet carrying direction.

Although an exemplary embodiment of the present invention has been shown and described, it will be apparent to those having ordinary skill in the art that a number of changes, modifications, or alterations to the invention as described herein may be made, none of which departs from the sprit of the present invention. All such changes, modifications, and alterations should therefore be seen as within the scope of the present invention.

What is claimed is:

1. A sheet post-processing apparatus comprising:

a folding blade that presses and turns in stacked sheets of paper having images formed thereon;

a middle-folding roller pair that folds in the middle the sheets of paper turned-in by the folding blade, by pinching and pressing the same at a nip;

a fold-enhancing roller pair including an upper fold-enhancing roller and a lower fold-enhancing roller, which pinches and presses the sheets of paper folded in the middle at the nip;

a control device configured to control the fold-enhancing roller pair to move faster in a homeward direction than in an outbound direction, both directions being orthogonal to a sheet carrying direction, and to move between one end of the sheets of paper and another end with plural switching back movements of the fold-enhancing roller pair which is in contact with the sheets of paper, the switching back movements including:

a first switching point different from the another end at which the fold-enhancing roller pair switches direction of movement to move in a direction towards the one end;

a second switching point nearer to the one end than the first switching point and nearer to the another end than the one end at which the fold-enhancing roller pair switches direction of movement to move in a direction towards the another end; and a third switching point different from the another end and nearer to the another end than the first switching point at which the fold-enhancing roller pair switches direction of movement to move in a direction towards the one end; and a roller guide pair which is provided at the front and rear in the direction of advancement of the fold-enhancing roller pair so as to define an opening at the nip between the upper fold-enhancing roller and the lower fold-enhancing roller, and is bent downward at free ends so as to cover part of the lower fold-enhancing roller.

2. The sheet post-processing apparatus according to claim 1, further comprising:

a carrier guide which pinches and presses the sheets of paper from above and below in association with the movement of the fold-enhancing roller pair.

3. The sheet post-processing apparatus according to claim 1, wherein the sheet post-processing apparatus changes the length of the sheets of paper protruded from the middle-folding roller toward the fold-enhancing roller pair according to the number of stacked sheets of paper.

4. The sheet post-processing apparatus according to claim 1, wherein the sheet post-processing apparatus changes the stop position of the sheets of paper at the time of fold enhancement for each bundle of sheets which is to be subjected to the fold enhancement within the width of the fold-enhancing rollers and within the effective width for performing the fold-enhancing process.

5. The sheet post-processing apparatus according to claim 1, wherein the fold-enhancing roller pair performs a plurality of times, a reciprocating movement which changes the direction of movement without the fold-enhancing roller pair being positioned at a home position or a terminal position which is the limit of movement toward an end that is opposite the home position at the time of fold enhancement of the sheets of paper.

6. The sheet post-processing apparatus according to claim 1, wherein the sheet post-processing apparatus changes one or both of a number of times and a velocity of the reciprocating movement according to the number of sheets of paper.

7. The sheet post-processing apparatus according to claim 1, wherein the sheet post-processing apparatus changes one or both of a number of times and a velocity of the reciprocating movement according to one or both of the number of sheets of paper or a quality mode entered by a user.

8. A sheet post-processing apparatus comprising:

a folding blade that presses and turns in stacked sheets of paper having images formed thereon;

a middle-folding roller pair that folds in the middle the sheets of paper turned-in by the folding blade, by pinching and pressing the same at a nip;

a fold-enhancing roller pair including an upper fold-enhancing roller and a lower fold-enhancing roller which pinches and presses the sheets of paper folded in the middle at the nip, a control device configured to control the fold-enhancing roller pair to move in a direction orthogonal to a sheet carrying direction, and to move between one end of the sheets of paper and another end with plural switching back movements of the fold-enhancing roller pair which is in contact with the sheets of paper, the switching back movements including:

a first switching point different from the another end at which the fold-enhancing roller pair switches direction of movement to move in a direction towards the one end;

a second switching point nearer to the one end than the first switching point and nearer to the another end than the one end at which the fold-enhancing roller pair switches direction of movement to move in a direction towards the another end; and a third switching point different from the another end and nearer to the another end than the first switching point at which the fold-enhancing roller pair switches direction of movement to move in a direction towards the one end: and a roller guide pair which is provided at the front and rear in the direction of advancement of the fold-enhancing roller pair so as to define an opening at the nip between the upper fold-enhancing roller and the lower fold-enhancing roller, and is bent downward at free ends so as to cover part of the lower fold-enhancing roller.

9. The sheet post-processing apparatus according to claim 8, further comprising a carrier guide which pinches and presses the sheets of paper from above and below in association with the movement of the fold-enhancing roller pair.

10. The sheet post-processing apparatus according to claim 8, wherein the sheet post-processing apparatus changes the length of the sheets of paper protruded from the middle-folding roller toward the fold-enhancing roller pair according to the number of stacked sheets of paper.

11. The sheet post-processing apparatus according to claim 8, wherein the sheet post-processing apparatus changes the stop position of the sheets of paper at the time of fold enhancement for each bundle of sheets which is to be subjected to the fold enhancement within the width of the fold-enhancing rollers and within the effective width for performing the fold-enhancing process.

12. The sheet post-processing apparatus according to claim 8, wherein the fold-enhancing roller pair performs a plurality of times, a reciprocating movement which changes the direction of movement without the fold-enhancing roller pair being positioned at the home position or the terminal position which is the limit of movement toward an end that is opposite the home position, at the time of fold enhancement of the sheets of paper.

13. The sheet post-processing apparatus according to claim 8, wherein the sheet post-processing apparatus changes one or both of a number of times and a velocity of the reciprocating movement according to the number of sheets of paper.

14. The sheet post-processing apparatus according to claim 8, wherein the sheet post-processing apparatus changes one or both of a number of times and a velocity of the reciprocating movement according to one or both of the number of sheets of paper or the quality mode entered by a user.

15. A sheet post-processing apparatus comprising:

a folding blade that presses and turns in stacked sheets of paper having images formed thereon;

a middle-folding roller pair that folds in the middle the sheets of paper turned-in by the folding blade, by pinching and pressing the same at a nip;

a fold-enhancing roller pair including an upper fold-enhancing roller and a lower fold-enhancing roller which changes the direction of movement at a position of pinching the sheets of paper;

a control device configured to control the fold-enhancing roller pair to move in a direction orthogonal to a sheet carrying direction, and to pinch and press the sheets of paper folded in the middle at the nip and to move between one end of the sheets of paper and another end with plural switching back movements of the fold-enhancing roller pair which is in contact with the sheets of paper, the switching back movements including:

a first switching point different from the another end at which the fold-enhancing roller pair switches direction of movement to move in a direction towards the one end;

a second switching point nearer to the one end than the first switching point and nearer to the another end than the one end at which the fold-enhancing roller pair switches direction of movement to move in a direction towards the another end; and a third switching point different from the another end and nearer to the another end than the first switching point at which the fold-enhancing roller pair switches direction of movement to move in a direction towards the one end; and a roller guide pair which is provided at the front and rear in the direction of advancement of the fold-enhancing roller pair so as to define an opening at the nip between the upper fold-enhancing roller and the lower fold-enhancing roller, and is bent downward at free ends so as to cover part of the lower fold-enhancing roller.

16. The sheet post-processing apparatus according to claim 15, further comprising a carrier guide which pinches and presses the sheets of paper from above and below in association with the movement of the fold-enhancing roller pair.

17. The sheet post-processing apparatus according to claim 15, wherein the sheet post-processing apparatus changes the length of the sheets of paper protruded from the middle-folding roller toward the fold-enhancing roller pair according to the number of stacked sheets of paper.

18. The sheet post-processing apparatus according to claim 15, wherein the sheet post-processing apparatus changes the stop position of the sheets of paper at the time of fold enhancement for each bundle of sheets which is to be subjected to the fold enhancement within the width of the fold-enhancing rollers and within the effective width for performing the fold-enhancing process.

19. The sheet post-processing apparatus according to claim 15, wherein the fold-enhancing roller pair performs a plurality of times, a reciprocating movement which changes the direction of movement without the fold-enhancing roller pair being positioned at a home position or a terminal position which is the limit of movement toward an end that is opposite the home position, at the time of fold enhancement of the sheets of paper.

20. The sheet post-processing apparatus according to claim 15, wherein the sheet post-processing apparatus changes one or both of a number of times and a velocity of the reciprocating movement according to the number of sheets of paper.

* * * * *